US012241469B2

(12) United States Patent
Koester et al.

(10) Patent No.: US 12,241,469 B2
(45) Date of Patent: Mar. 4, 2025

(54) COMPRESSOR WITH FLUID SEPARATOR

(71) Applicant: Hanon Systems, Daejeon (KR)

(72) Inventors: Steven J. Koester, Sylvania, OH (US); Brad Crenshaw, Riverview, MI (US); Mark Honkala, Howell, MI (US)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/408,938

(22) Filed: Jan. 10, 2024

(65) Prior Publication Data

US 2024/0384721 A1 Nov. 21, 2024

Related U.S. Application Data

(60) Provisional application No. 63/502,541, filed on May 16, 2023.

(51) Int. Cl.
*F04C 29/02* (2006.01)
*B01D 35/02* (2006.01)

(52) U.S. Cl.
CPC ..... *F04C 29/026* (2013.01); *F04C 2240/30* (2013.01)

(58) Field of Classification Search
CPC .... F04C 29/026; F04C 29/029; B01D 35/027; B01D 35/02
See application file for complete search history.

(56) References Cited

U.S. PATENT DOCUMENTS 6,511,530 B2 1/2003 Iwanami et al.
7,736,136 B2 6/2010 Ohtake
8,202,071 B2 6/2012 Kii et al.
9,828,997 B2 * 11/2017 Kawano ..... F04C 29/026
2021/0180595 A1 6/2021 Fagerli et al.

FOREIGN PATENT DOCUMENTS

CN 106704197 A * 5/2017 ..... F04C 29/026
CN 107044414 A * 8/2017 ..... F04C 29/026
DE 102016217358 A1 * 3/2018 ..... F04C 18/02
JP 2006-105064 A 4/2006
JP 2007-182773 A 7/2007
JP 2007-187073 A 7/2007
KR 10-2019-0001689 A 1/2019
KR 10-2020-0055298 A 5/2020

OTHER PUBLICATIONS

English translation of CN106704197 by PE2E, Apr. 29, 2024.*
English translation of CN107044414 by PE2E, Apr. 29, 2024.*
DE102016217358 by PE2E Jul. 24, 2024.*

* cited by examiner

*Primary Examiner* — Deming Wan
(74) *Attorney, Agent, or Firm* — James D. Miller; Shumaker, Loop & Kendrick, LLP

(57) ABSTRACT

A compressor with a fluid separator is disclosed. The compressor is configured to compressor a first fluid (e.g., a refrigerant gas) having a second fluid (e.g., a lubricant) suspended therein. The fluid separator includes a main body having at least one aperture formed therethrough and is configured to separate the second fluid from the first fluid. The fluid separator is installed in a separation chamber of the compressor, wherein the fluid separator includes at least one retention feature to militate against axial movement of the fluid separator within the separation chamber.

20 Claims, 7 Drawing Sheets

COMPRESSOR WITH FLUID SEPARATOR

CROSS-REFERENCE TO RELATED APPLICATION

This application claims the benefit of U.S. Provisional Patent Application Ser. No. 63/502,541, filed May 16, 2023, the entirety of which is herein incorporated by reference.

FIELD

The present disclosure relates to a compressor, and more particularly to a compressor including a fluid separator having a retention feature.

BACKGROUND

Known scroll compressors include a housing, and the housing includes a front housing, a shell, and a rear housing. A conventional scroll compressor is shown and described in U.S. Pat. No. 8,202,071, hereby incorporated herein by reference in its entirety.

Such known compressors also include a fixed scroll-including a first spiral element, and an orbiting scroll including a second spiral element. The spiral elements interfit with one another to form a sealed-off fluid pocket. Such known compressors further include a driving mechanism which drives the orbiting scroll in an orbiting motion, and a rotation preventing mechanism which prevents the orbiting a scroll from rotating. The orbiting scroll, the fixed scroll, the driving mechanism, and the rotation preventing mechanism are positioned inside the housing. Further, such known compressors also include a suction chamber and a discharge chamber, and the fixed scroll separates the suction chamber from the discharge chamber. The driving mechanism and the rotation preventing mechanism are positioned inside the suction chamber.

In the known compressor, a refrigerant gas is introduced into the suction chamber via an external refrigerant circuit. To achieve high reliability and long life of the compressor, a fluid suspended in the refrigerant gas lubricates the driving mechanism, the rotation preventing mechanism, and sliding portions located between the fixed scroll and the orbiting scroll. In addition to lubricating the compressor, the fluid also carries away heat and performs a sealing function, particularly between mating surfaces of the fixed scroll and the orbiting scroll. Specifically, during operation, the fluid separates from the refrigerant gas, and accumulates in a reservoir located in a lower portion of the compressor. It is desirable that the fluid contained in the refrigerant gas be separated before leaving a housing of the compressor, so that the fluid may flow back into the reservoir.

Prior art oil separators, such as cyclone separators, which include filtering means and spaces to reduce the velocity of flow, are known in the art.

U.S. Pat. No. 6,511,530 entitled COMPRESSOR WITH OIL SEPARATOR, hereby incorporated herein by reference in its entirety, discloses an oil separating unit or separator pipe. The separator pipe is a funnel-shaped member adapted to cause a swirling movement of a refrigerant gas. Such swirling movement applies a centrifugal force to a lubricating oil contained in the refrigerant gas, thereby separating the lubricating oil from the refrigerant gas. The separator pipe is coaxially press fitted into a separation chamber of the compressor so that an outer periphery of the funnel-shaped member contacts an inner circumferential wall of the oil separation chamber and is affixed thereto.

U.S. Pat. No. 7,736,136 entitled COMPRESSOR INCLUDING SEPARATION TUBE ENGAGEMENT MECHANISM, hereby incorporated herein by reference in its entirety, discloses a separation tube for separating a lubricating oil from a high pressure refrigerant gas. The separation tube is a hollow member having a passageway formed therethrough. The passageway facilitates the flow of the high pressure refrigerant gas to a discharge port. The separation tube is disposed in a separation chamber of a compressor. An upper end of the separation tube is pressed in the separation chamber and in contact with an inner wall of the separation chamber. A movement of the separation tube in an anti-insertion direction is regulated by either engaging a regulating ring with an engagement groove formed in the separation chamber or threading a seal bolt with an inner surface of an opening at an upper end of the separation chamber.

U.S. Pat. App. Pub. No. 2021/0180595 entitled COMPRESSOR MODULE AND ELECTRIC-POWERED REFRIGERANT COMPRESSOR, hereby incorporated herein by reference in its entirety, discloses a separator device for separating a lubricating mixed in with a high pressure refrigerant gas. The separator device has a hollow-cylindrical chamber wall, which forms a separation chamber. A separator is disposed in the separation chamber of the separator device to form an annular space between the separator and the hollow-cylindrical chamber wall of the separator device.

Although the aforementioned structures operate effectively, the structures involve higher manufacturing costs. Additionally, the structures are complex and/or require tight machining tolerances and/or additional components to prevent back-out.

Accordingly, it would be desirable to produce a compressor with a fluid separator, wherein a cost, complexity, and manufacturing requirements of the fluid separator are minimized.

SUMMARY

In concordance and agreement with an embodiment of the present disclosure, an improved a fluid separator which is easy to install and may be used in a variety of compressor designs is surprisingly discovered.

In one embodiment, a fluid separator for a compressor, comprises: a main body including at least one retention feature configured to permit the fluid separator to be fixedly positioned in the compressor at a desired location, wherein a fluid separation chamber of the compressor includes a receiving feature configured to receive the at least one retention feature so that movement of the fluid separator is prevented as the fluid separator is axially constrained by shoulders of the compressor formed on each side of the receiving feature.

In another embodiment, a compressor, comprises: a housing including a discharge chamber and a fluid separation chamber, wherein the fluid separation chamber is in communication with the discharge chamber to receive a first fluid having a second fluid suspended therein; and a fluid separator disposed in the fluid separation chamber, wherein the fluid separator includes: a main body including at least one retention feature configured to permit the fluid separator to be fixedly positioned at a desired location within the fluid separation chamber, wherein the fluid separation chamber of the compressor includes a receiving feature configured to receive the at least one retention feature so that movement of the fluid separator is prevented as the fluid separator is axially constrained by shoulders of the compressor formed on each side of the receiving feature.

In yet another embodiment, a compressor, comprises: a housing including a discharge chamber and a fluid separation chamber, wherein the fluid separation chamber is in communication with the discharge chamber to receive a first fluid having a second fluid suspended therein, and wherein the fluid separation chamber includes a channel portion; and a fluid separator disposed in the fluid separation chamber and configured to separate the second fluid from the first fluid, wherein the fluid separator includes at least one retention feature configured to be received in the channel portion of the fluid separation chamber, and wherein movement of the fluid separator is prevented as the at least one retention feature is axially constrained by shoulders formed on opposite sides of the channel portion.

As aspects of some embodiments, the main body further includes at least one aperture formed therein.

As aspects of some embodiments, the at least one retention feature is configured to cooperate with a surface of the compressor to form a substantially fluid-tight seal therebetween.

As aspects of some embodiments, the at least one retention feature is at least one radially outwardly extending protuberance.

As aspects of some embodiments, the at least one retention feature is at least one radially outwardly extending surface element.

As aspects of some embodiments, the at least one retention feature is an annular array of spaced apart surface elements.

As aspects of some embodiments, the at least one retention feature is formed continuously around an outer surface of the main body.

As aspects of some embodiments, the at least one retention feature includes a sloped portion to facilitate installation of the fluid separator in the compressor.

As aspects of some embodiments, the receiving feature is a radially extending channel portion formed in the fluid separation chamber.

As aspects of some embodiments, the fluid separator further includes a tube portion extending outwardly from the main body.

As aspects of some embodiments, the fluid separation chamber includes a cylindrical portion, a frustoconical portion, and a channel portion.

BRIEF DESCRIPTION OF THE DRAWINGS

Further details, features and advantages of configurations of the present disclosure emerge from the following description of exemplary embodiments with reference to the associated figures.

DETAILED DESCRIPTION

The following detailed description and appended drawings describe and illustrate various embodiments of the present disclosure. The description and drawings serve to enable one skilled in the art to make and use the present disclosure, and are not intended to limit the scope of the present disclosure in any manner. In respect of the methods disclosed, the steps presented are exemplary in nature, and thus, the order of the steps is not necessary or critical.

A" and "an" as used herein indicate "at least one" of the item is present; a plurality of such items may be present, when possible. Spatially relative terms, such as "front," "back," "inner," "outer," "bottom," "top," "horizontal," "vertical," "upper," "lower," "side," "above," "below," "beneath," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

As used herein, substantially is defined as "to a considerable degree" or "proximate" or as otherwise understood by one ordinarily skilled in the art or as otherwise noted. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section.

Figure 1:
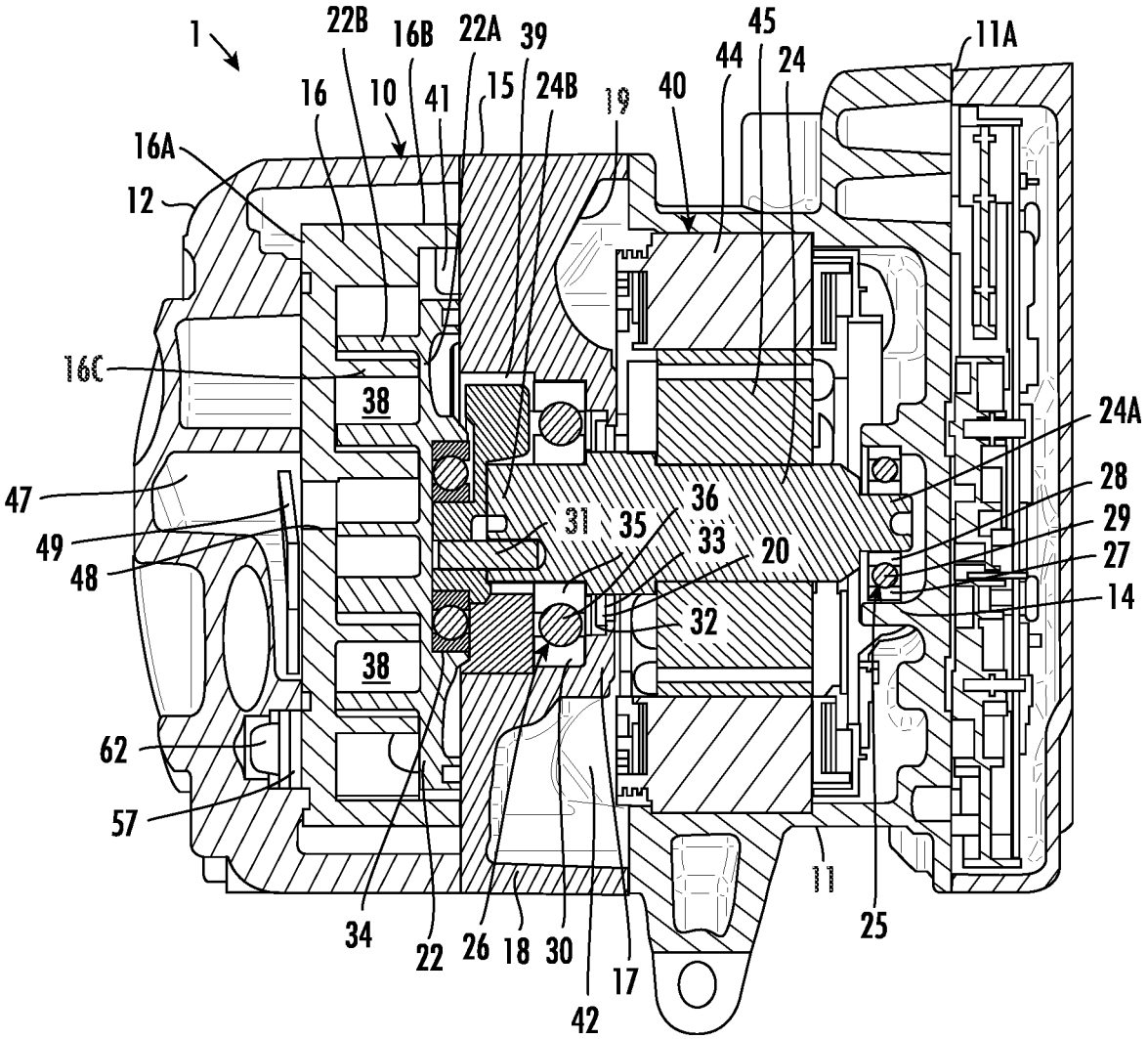
FIG. 1 PRIOR ART
FIG. 1 is a cross sectional elevational view of a conventional scroll compressor.
Figure 2:
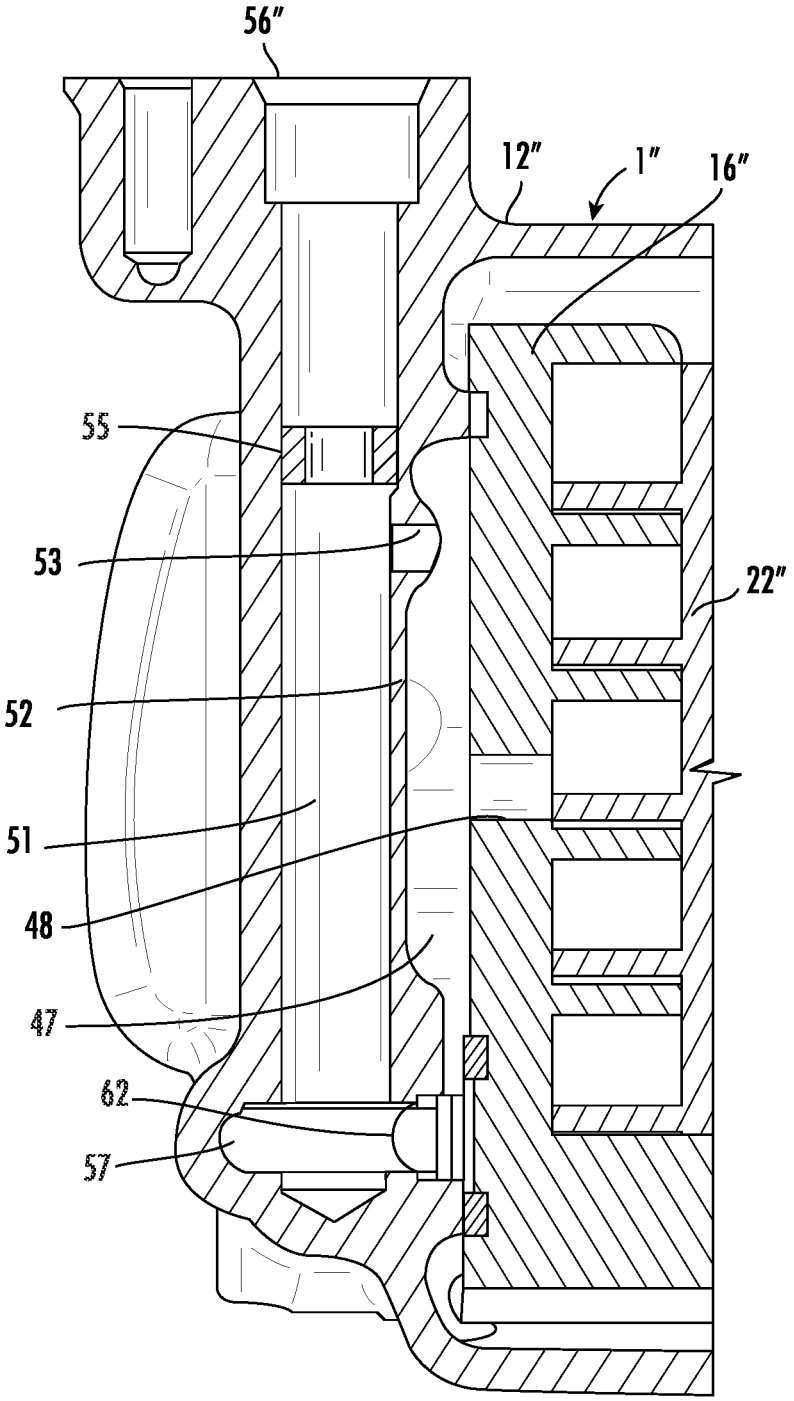
FIG. 2 PRIOR ART
FIG. 2 is a fragmentary section view of a portion of the scroll compressor of FIG. 1, wherein a prior art fluid separator is shown.
Figures 3, 4:
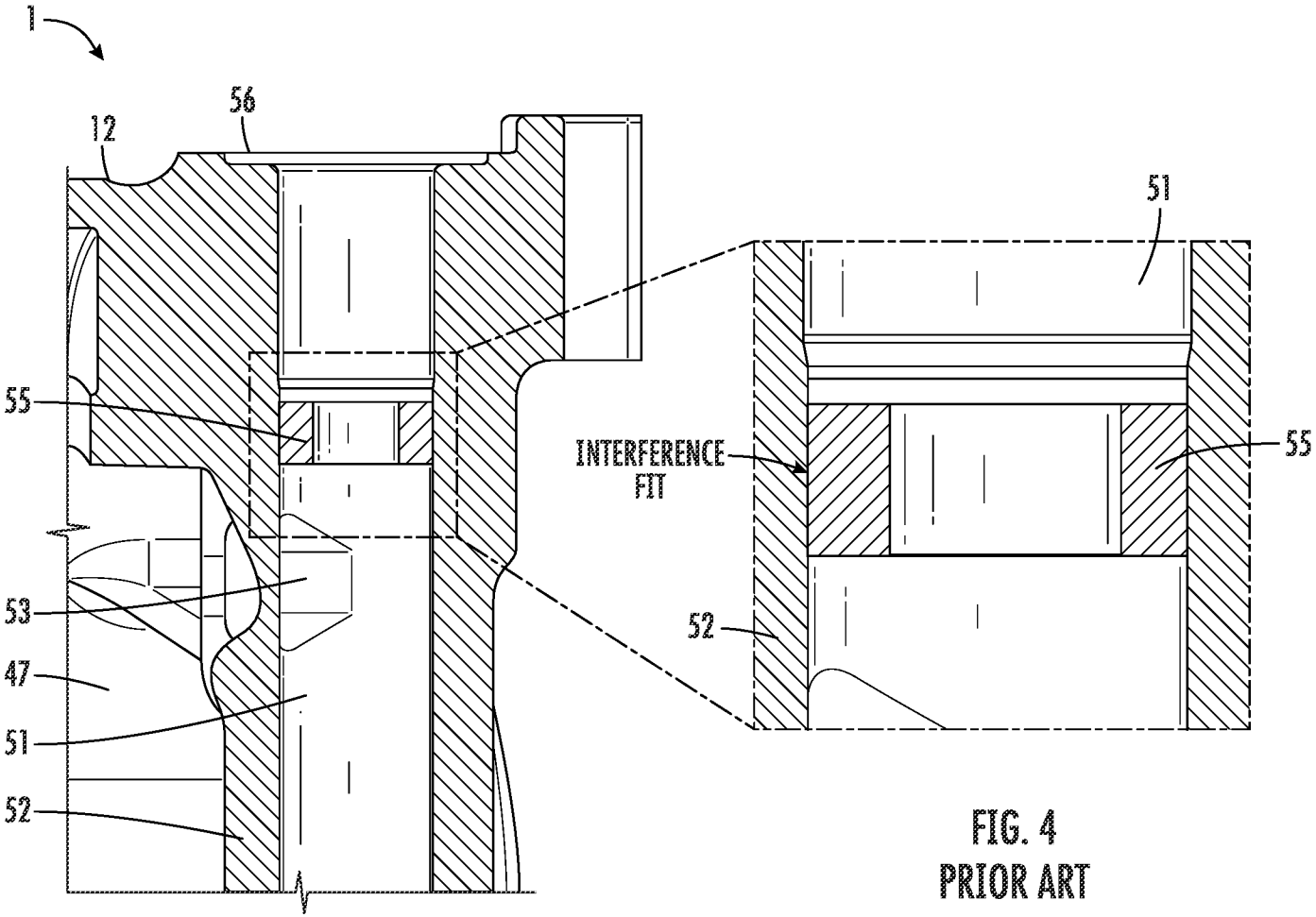
FIG. 4 PRIOR ART
FIG. 3 PRIOR ART
FIG. 3 is a fragmentary section view of a portion of the scroll compressor of FIG. 1, wherein the prior art fluid separator is shown more clearly.
FIG. 4 is an enlarged section view of a portion of the scroll compressor shown within a dashed rectangle area of FIG. 3.
Figure 5C:
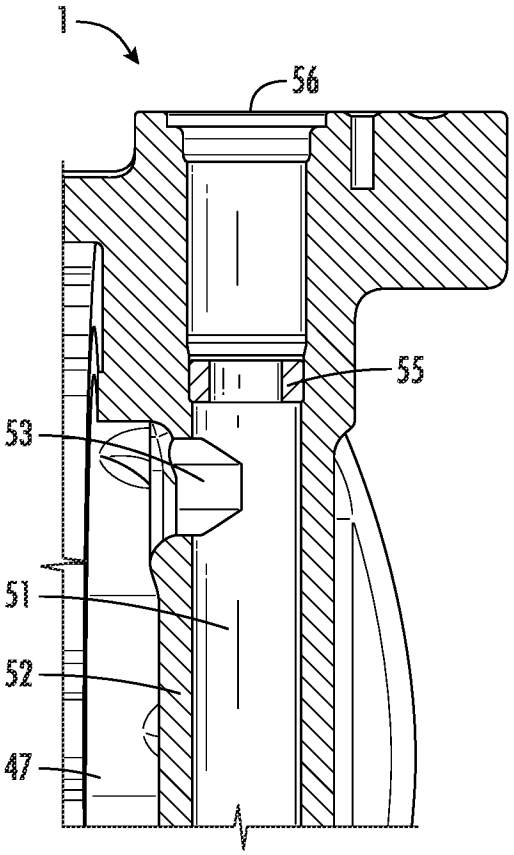
FIG. 5C PRIOR ART
FIG. 5C is a fragmentary section view of a portion of the scroll compressor of FIG. 1 showing a final position of the fluid separator which has been interference press fit into the separation chamber.
Figure 5B:
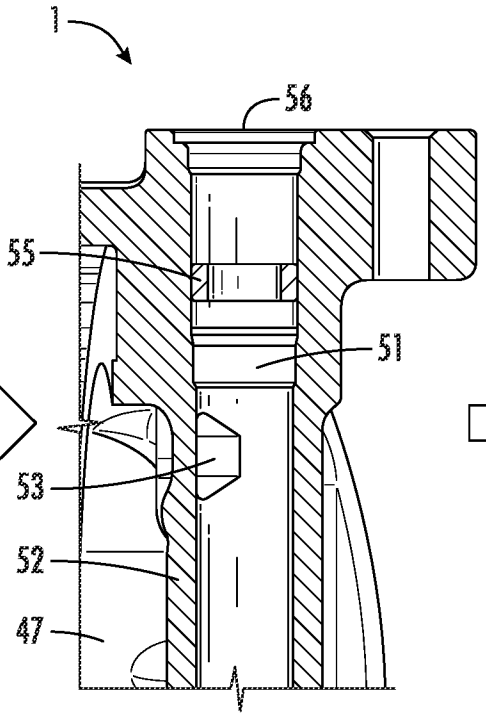
FIG. 5B PRIOR ART
FIG. 5B is a fragmentary section view of the portion of the scroll compressor of FIG. 5A showing mid-insertion of the fluid separator into the separation chamber.
Figure 5A:
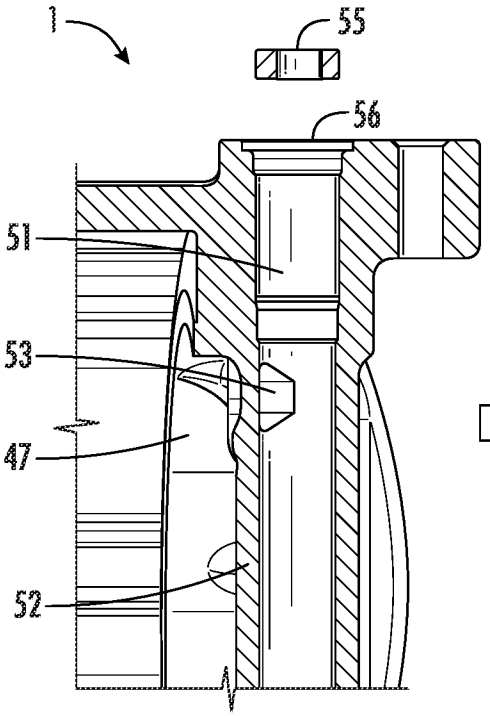
FIG. 5A PRIOR ART
FIG. 5A is a fragmentary section view of a portion of the scroll compressor of FIG. 1 showing pre-insertion of the fluid separator into a separation chamber.

FIGS. 1 and 2 show a conventional motor-driven scroll type compressor 1. It should be noted that FIGS. 1-2 are provided to detail a general configuration and operation of a scroll type compressor. It is understood that other configurations for the compressor 1 can be used as desired. A housing 10 includes a cylindrical first housing 11 with a cover-like second housing 12 and a shaft support portion 15. The shaft support portion 15 is provided intermediate the first housing 11 and the second housing 12. The first housing 11, the second housing 12, and the shaft support portion 15 are joined by any conventional method such as fasteners, for example.

The first housing 11 may have a cylindrical boss 14 protruding from the center of wall 11A of the first housing 11. The shaft support portion 15 typically has an inner cylindrical portion 17 and an outer cylindrical portion 18 connected by a web portion 19. The inner cylindrical portion 17 has a central bore 20 for receiving a rotary shaft 24 therethrough. The compressor 1 has a rotation prevention pin (not depicted) for preventing a movable scroll member 22 from being rotated on its own axis.

The shaft support portion 15 and the boss 14 rotatably support the rotary shaft 24 at the opposite ends 24A, 24B thereof through radial bearings 25, 26, respectively. The bearing 25 has an outer ring 27, an inner ring 28, and a plurality of rollers 29 arranged between the rings 27, 28. The bearing 25 is fitted in the boss 14, rotatably supporting the end 24A of the rotary shaft 24. On the other hand, the bearing 26 is fitted in the shaft support portion 15. The bearing 26 has an outer ring 30, an inner ring 35, and a plurality of rollers 36 arranged between the rings 30, 35. The rotary shaft 24 inserted through the central bore 20 is fitted in the inner ring 35 of the bearing 26, as shown in FIG. 1. Thus, the bearing 26 rotatably supports the end 24B of the rotary shaft 24. A seal member 32 is interposed between the shaft support portion 15 and the rotary shaft 24 and held by a circlip 33 for sealing the rotary shaft 24.

As depicted, the second housing 12 may be configured to accommodate therein a fixed scroll member 16. The fixed scroll member 16 has a base wall 16A, a cylindrical peripheral wall 16B, and a fixed scroll wall 16C formed inside the peripheral wall 16B and extending axially outward from the base wall 16A along a central axis of the compressor 1.

On the other hand, the movable scroll member 22 is provided between the shaft support portion 15 and the fixed scroll member 16 and supported by a radial bearing 34. The movable scroll member 22 has a disk-shaped movable base wall 22A and a movable scroll wall 22B extending axially outward from the movable base wall 22A along the central axis of the compressor 1.

The fixed scroll member 16 and the movable scroll member 22 are moveably engaged with each other through the fixed scroll wall 16C and the movable scroll wall 22B. The distal ends of the fixed scroll wall 16C and the movable scroll wall 22B are slidable on the movable base wall 22A and the fixed base wall 16A, respectively.

Compression chambers 38 are formed between the fixed base wall 16A with the fixed scroll wall 16C of the fixed scroll member 16 and the movable base wall 22A with the movable scroll wall 22B of the movable scroll member 22. A backpressure chamber 39 faces to the end 24B of the rotary shaft 24 between the front side of the movable base wall 22A (or the opposite side of the movable base wall 22A from the compression chamber 38) and the shaft support portion 15. Furthermore, the shaft support portion 15, the peripheral wall 16B and the outermost peripheral portion of the movable scroll wall, 22B cooperate to define therebetween a suction chamber 41.

The first housing 11 has formed therein a suction region 42 formed adjacent the shaft support portion 15. The suction region 42 communicates with the suction chamber 41 through a suction passage (not depicted) formed in the shaft support portion 15. In the suction region 42, a stator 44 of an electric motor 40 is fixed on the inner peripheral surface of the first housing 11 and a rotor 45 is located inward of the stator 44 and fixed on the rotary shaft 24. The rotor 45, the stator 44 and the rotary shaft 24 cooperatively form the electric motor 40 and the rotor 45 is rotated integrally with the rotary shaft 24 when electric current is supplied to the stator 44 (when the stator 40 is energized).

The first housing 11 has formed therethrough at a position adjacent to the front end thereof an inlet (not depicted). In certain instances when the compressor 1 is part of a heating, ventilating, and air conditioning (HVAC) system (not depicted), the suction region 42, via the inlet, communicates with an evaporator (not shown) of the HVAC system. The evaporator may further communicate with an expansion valve and a condenser of the HVAC system. A first fluid (i.e., a low-pressure and low-temperature refrigerant gas) in the HVAC system is supplied into the suction chamber 41 through the inlet, the suction region 42 and the suction passage.

A discharge chamber 47 is formed between the fixed base wall 16A and an inner surface of the second housing 12. The fixed base wall 16A has a discharge outlet 48 through which the compression chamber 38 is in fluid communication with the discharge chamber 47. The fixed base wall 16A has a discharge valve (not shown) for opening and closing the discharge outlet 48 and a retainer 49 for regulating an opening degree of the discharge valve.

As shown in FIG. 2, the second housing 12 has formed therein behind the discharge chamber 47, a fluid separation chamber 51 extending perpendicular to the central axis of the compressor 1 and also a partition wall 52 between the fluid separation chamber 51 and the discharge chamber 47. The partition wall 52 has formed therethrough a discharge passage 53 interconnecting the fluid separation chamber 51 and the discharge chamber 47. A fluid separator 55 may be provided in the fluid separation chamber 51 to separate a second fluid (e.g., a lubricating fluid, oil, etc.) from the first fluid. As best seen in FIGS. 3, 4, and 5A-5C, the fluid separator 55 has a cylindrical shape and is interference press fitted into the fluid separation chamber 51. The second fluid is separated by the action of the centrifugal force from the first fluid flowing from the discharge chamber 47 through the discharge passage 53 into the fluid separation chamber 51 and through the fluid separator 55 to a discharge port 56. The separated second fluid falls to be reserved in the fluid separation chamber 51. An end of the fluid separation chamber 51 feeds into the discharge port 56 through which the fluid separating chamber 51 communicates with the condenser of the HVAC system.

The fluid separation chamber 51 communicates with the backpressure chamber 39 through a fluid passage 57 so that a backpressure flow (i.e., the fluid under a discharge pressure) is supplied to the backpressure chamber 39 through the fluid passage 57. A fluid filter 62 may be fixedly mounted in the fluid passage 57 for removing foreign matters from the second fluid.

The following will describe the operation of the above-described scroll type compressor. When the rotary shaft 24 of the motor 40 is driven to rotate by the operation of a vehicle operator, a pin 31 turns around the axis of the fixed scroll member 16. In this case, the rotation prevention pin is in sliding and rolling contact with the inner surface of the movable scroll member 22 and, accordingly, the rotation of the movable scroll member 22 on its own axis is prevented and the movable scroll member 22 makes an orbital motion around the axis of the rotary shaft 24. Thus, the compression chambers 38 are moved radially inwardly from the outer peripheral side of the fixed and movable scroll members 16, 22 toward their center by the orbital motion of the movable scroll member 22, thereby progressively reducing volume thereof. Therefore, the first fluid introduced into the suction chamber 41 and then the compression chamber 38 from the evaporator through the inlet, the suction region 42 and the suction passage is compressed in the compression chamber 38. The first fluid compressed to a discharge-pressure is discharged through the discharge outlet 48 into the discharge chamber 47 and then flows into the fluid separation chamber 51 through the discharge passage 53. After the second fluid is separated from first fluid by the fluid separator 55 in the fluid separation chamber 51, the first fluid flows from the fluid separation chamber 51 through the discharge port 56 to be discharged from the compressor 1 to the condenser. Thus, the air conditioning for the vehicle is performed.

The second fluid separated from the first fluid falls from the fluid separator 55 to be reserved in the fluid separation chamber 51. The second fluid reserved in the fluid separation chamber 51 is supplied to the backpressure chamber 39 through the fluid passage 57 together with a small amount of the first fluid. While the second fluid passes through the fluid passage 57, foreign matters contained in the second fluid are removed therefrom by the fluid filter 62 so that foreign matters are prevented from being accumulated in a throttle (not depicted) located downstream of the fluid filter 62. A pressure in the backpressure chamber 39 is restricted to a determined pressure by the throttle in the fluid passage 57. The second fluid supplied to the backpressure chamber 39 serves to lubricate any friction-generating components such as the bearing 26, the bearing 34, and the eccentric pin 31, for example, as a part of the drive for the movable scroll member 22. The pressure in the backpressure chamber 39 functions to oppose the pressure in the compression chambers 38 so as to urge the movable scroll member 22 toward the fixed scroll member 16 thereby to reduce sliding resistance between the movable base wall 22A and the shaft support portion 15 and also to secure the airtightness of the compression chambers 38.

Figure 6:
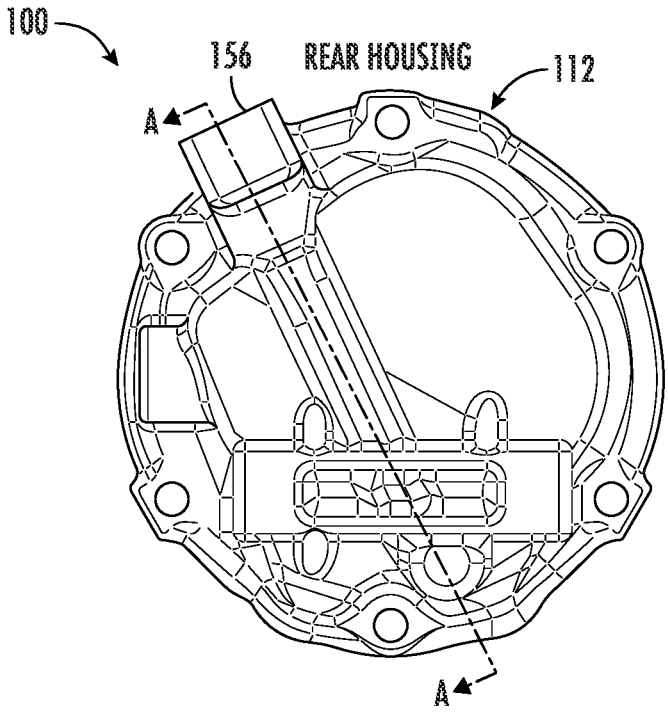
FIG. 6 is an elevational view of an exemplary rear housing of a scroll compressor according to an embodiment of the present disclosure.
Figure 7:
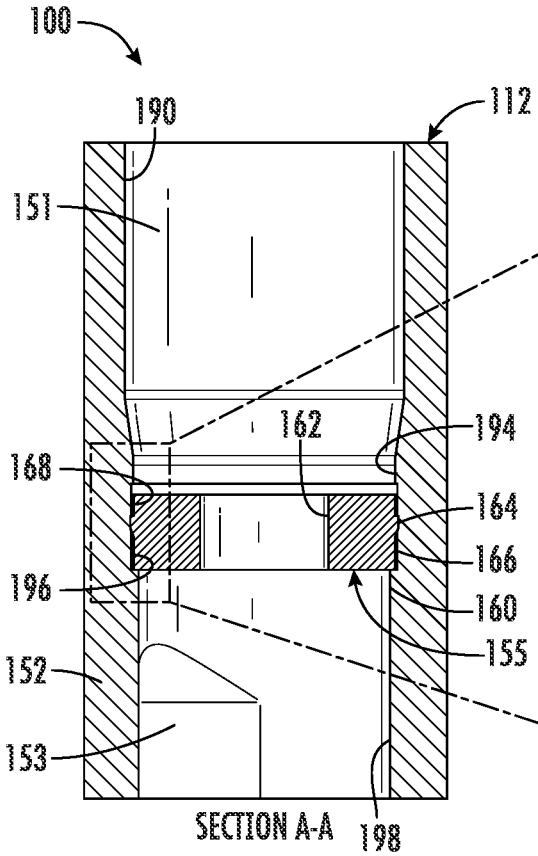
FIG. 7 is an enlarged fragmentary section view of a portion of the rear housing of FIG. 6 taken along Section line A-A, wherein an exemplary embodiment of a fluid separator is shown.
Figure 8:
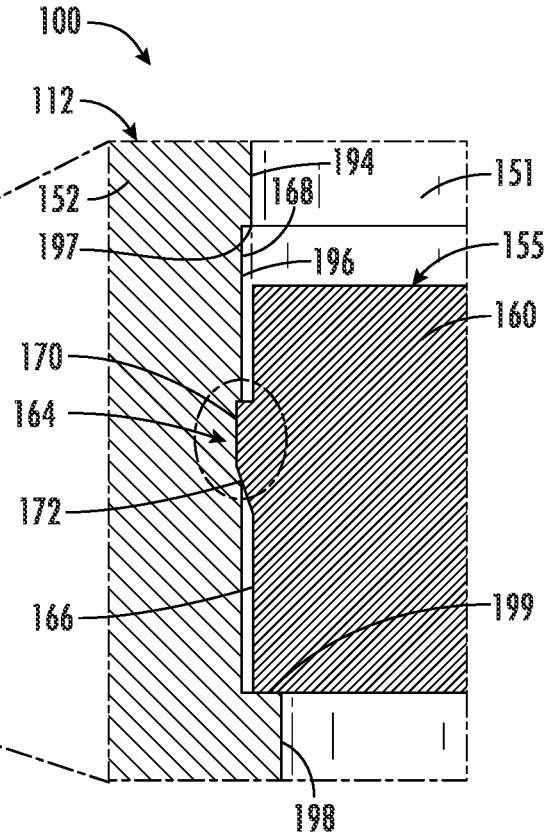
FIG. 8 is an enlarged section view of a portion of the rear housing shown within a dashed rectangle area of FIG. 7, wherein a portion of the fluid separator is shown more clearly within a dashed circle area.

FIGS. 6-8 illustrate a compressor 100 including a housing 112 with a fluid separator 155 in accordance with an embodiment of the present disclosure. Structure of the compressor 100 may be substantially similar to structure of the compressor 1 shown in FIGS. 1-2 as described herein. It is understood that the fluid separator 155 may be installed in any compressor as desired such as a vapor injection (VI) type scroll compressor, for example. It should be noted that the VI type scroll compressor differs from the conventional compressor described hereinabove in that it includes a VI valve assembly between a housing and a fixed scroll.

As depicted, the fluid separator 155 may be disposed in a fluid separation chamber 151 of the housing 112 of the compressor 100. The fluid separator 155 includes a main body 160. As shown, the main body 160 is substantially cylindrical in shape with at least one aperture 162 formed therethrough. It is understood that the fluid separator 155 may have other shapes as desired. The main body 160 may be produced from a plastic material, although other materials can be used as desired. If formed from a plastic material, advantageously, a weight thereof is minimized.

In some embodiments shown in FIGS. 7 and 8, the main body 160 includes at least one retention feature 164 formed on an outer peripheral surface 166 thereof. As depicted, the at least one retention feature 164 extends radially outwardly from the outer peripheral surface 166 of the main body 160. Functionally, the retention feature 164 cooperates with an inner surface 168 of the separation chamber 151 to form a substantially fluid-tight seal therebetween and militate against blow by or leakage past the fluid separator 155. The fluid separator 155 functions to permit the first fluid to flow through the at least one aperture 162 of the main body 160 while separating out the second fluid carried by the first fluid. The separated second fluid then flows through the fluid separation fluid chamber 151, into and through a fluid passage (identified as reference number 57 in FIGS. 1 and 2), to the backpressure chamber (identified as reference number 39 in FIG. 1) to lubricate any friction-generating components of the compressor 100.

In the embodiment of the fluid separator 155 shown in FIGS. 7 and 8, the retention feature 164 may be in the form of an annular array of spaced apart outwardly extending surface elements (e.g., protuberances, tabs, and the like). The retention feature 164 may comprise a first portion 170 and a second portion 172. As best seen within the dashed circle area of FIG. 8, the first portion 170 has a substantially constant outer diameter and the second portion 172 is sloped having a generally decreasing outer diameter from the first portion 170 to the outer peripheral surface 166 of the main body 160. Advantageously, the sloped second portion 172 of the at least one retention feature 164 allows for easier installation of the fluid separator 155 into the separation chamber 151, while providing a substantially fluid-tight seal between the inner surface 168 of the separation chamber 151 and the at least one retention feature 164 of the fluid separator 155.

Figure 9:
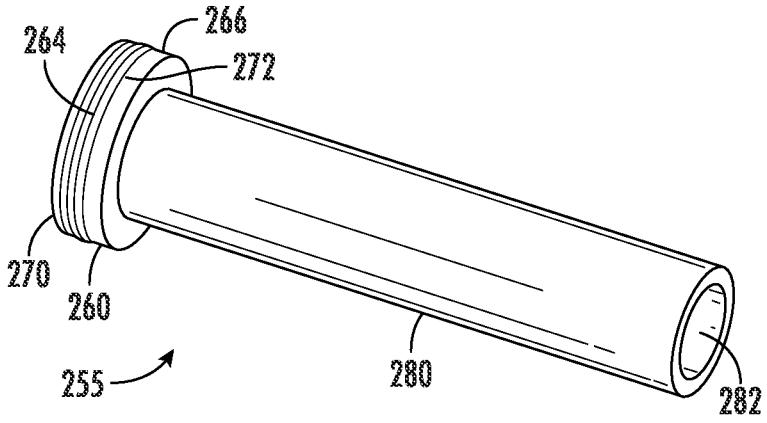
FIG. 9 is a perspective view of another exemplary embodiment of a fluid separator in accordance with the present disclosure.

It is understood that the at least one retention feature 164 may take various other forms such as a plurality of radially outwardly extending and circumferentially continuous rings, an annular array of spaced apart outwardly extending bumps or semi-circular protrusions, an annular array of spaced apart outwardly extending ribs, at least one radially outwardly extending collar formed continuously around the outer surface, or other protuberances, as shown in FIG. 9, for example.

Figure 10:
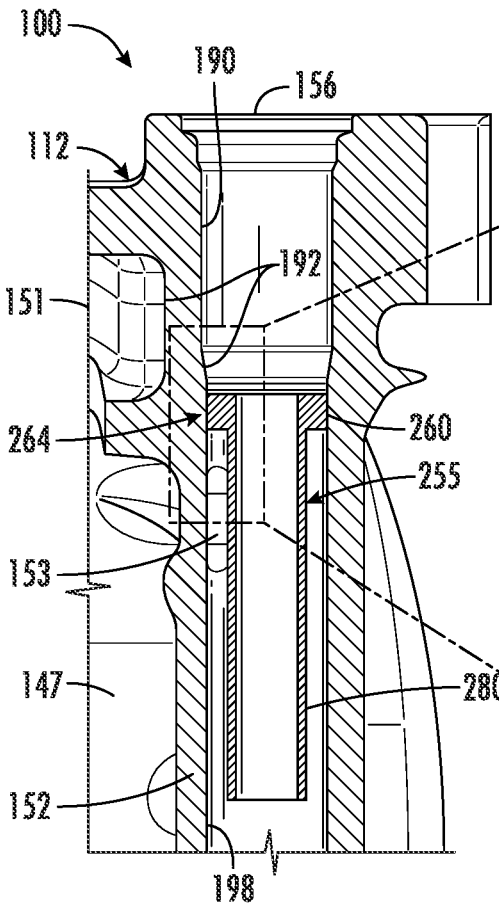
FIG. 10 is a fragmentary section view of a portion of the rear housing of FIG. 6 taken along Section line A-A, wherein the fluid separator of FIG. 9 is shown.
Figure 11:
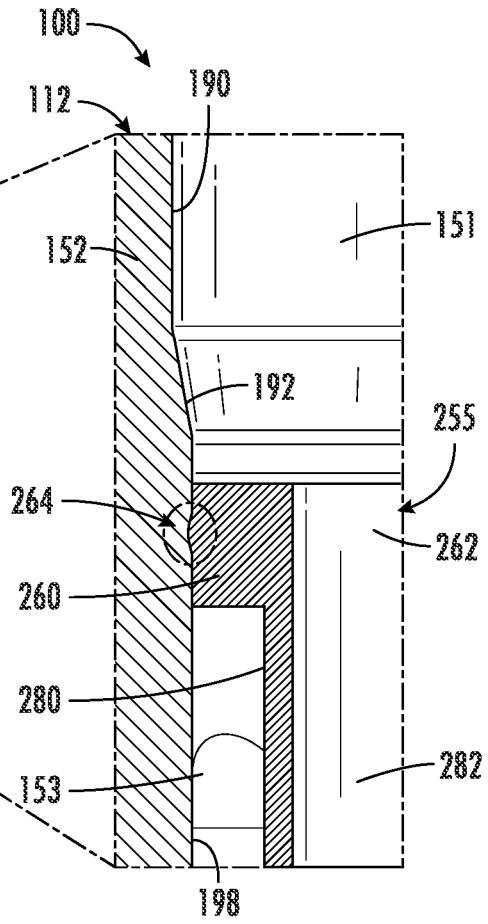
FIG. 11 is an enlarged section view of a portion of the rear housing shown within a dashed rectangle area of FIG. 10, wherein a portion of the fluid separator of FIG. 9 is shown more clearly within a dashed circle area.

FIGS. 9-11 depict a fluid separator 255 according to another embodiment of the present disclosure. Except as noted otherwise, structure of the fluid separator 255 is substantially similar to structure of the fluid separator 155 shown in FIGS. 7 and 8 as described herein but indicated with 200-series reference numerals. The fluid separator 255 may include a main body 260 and a cylindrical tube portion 280 extending axially from the main body 260 thereof.

The main body 260 includes at least one retention feature 264 formed on an outer peripheral surface 266 thereof. The at least one retention feature 264 cooperates with an inner surface 168 of the separation chamber 151 to form a substantially fluid-tight seal therebetween and militate against blow by or leakage past the fluid separator 255, thereby causing separation of the second fluid and the first fluid to flow through at least one aperture 262 of the fluid separator 255.

As illustrated, the at least one retention feature 264 may be in the form of an annular array of spaced apart outwardly extending surface elements (e.g., protuberances, tabs, and the like). In the embodiment of the fluid separator 255 shown in FIGS. 9-11, the at least one retention feature 264 may comprise at least one radially outwardly extending surface element formed continuously around a circumference of the main body 260. The at least one retention feature 264 having a first portion 270 and a second portion 272. As best seen in FIG. 9, the first portion 270 has a substantially constant outer diameter and the second portion 272 is sloped having a generally decreasing outer diameter from the first portion 270 to the outer peripheral surface 266 of the main body 260. Advantageously, the sloped second portion 272 of the at least one retention feature 264 allows for easier installation of the fluid separator 255 into the separation chamber 151, while providing a substantially fluid-tight seal between the inner surface 168 of the separation chamber 151 and the at least one retention feature 264 of the fluid separator 255.

The tube portion 280 may also include at least one aperture 282 formed therethrough. The at least one aperture 282 may be axially aligned with at least one aperture 262 of the main body 260. The tube portion 280 may be integrally formed with the main body 260 as a unitary structure as depicted in FIGS. 9-11 or as separate and distinct components of the fluid separator 255. The fluid separator 255 functions to permit the first fluid to flow through the at least one aperture 282 of the tube portion 280 and the at least one aperture 262 of the main body 260 while separating out the second fluid carried by the first fluid.

In some embodiments, the separation chamber 151 may be formed by a boring operation. In certain embodiments, the boring operation may be accomplished in phases. However, other machining or forming operations or methods may be used as desired. Adjacent the discharge port 156, the separation chamber 151 may be formed by a substantially right circular cylindrical portion 190 having a substantially constant diameter. Adjacent the right circular cylinder portion 190 in a direction away from the discharge port 156, a substantially frustoconical portion 192 may be formed. Adjacent the frustoconical portion 192 in a direction away from the discharge port 156 may be an annular contraction portion 194 and then adjacent thereto in a direction away from the discharge port 156, a receiving feature (i.e., a radially extending channel portion 196). Adjacent the channel portion 196 in a direction away from the discharge port 156 may be a remainder portion 198 of the separation chamber 151. As discussed hereinabove, each of these portions 190, 192, 194, 196, 198 may be formed by the boring operation or other operations or methods. For example, the channel portion 196 may be formed with a T-tool, similar to that used for forming channels for use with snap rings. The channel portion 196 cooperates with the at least one retention feature 164, 264 of the fluid separators 155, 255, respectively, to properly position the fluid separators 155, 255, hold the fluid separators 155, 255 in place, and militate against blow by or leakage of the second fluid past the fluid separators 155, 255. As best seen in FIG. 8, the channel portion 196 may include a first shoulder 197 and an opposing second shoulder 199. The shoulder 197 may be configured to engage a first axial surface of the fluid separators 155, 255 to militate against movement in a first direction towards the discharge port 156 and/or the shoulder 199 may be configured to engage a second axial surface of the fluid separators 155, 255 to militate against movement in an opposite second direction away from the discharge port 156. Alternatively, the shoulder 197 may be configured to engage a first axial surface of the first portion 170, 270 of the at least one retention feature 164, 264 to militate against movement in a first direction towards the discharge port 156 and/or the shoulder 199 may be configured to engage a second axial surface of the second portion 172, 272 of the at least one retention feature 164, 264 to militate against movement in an opposite second direction away from the discharge port 156. In yet another embodiment, the shoulder 197 may be configured to engage a first axial surface of the first portion 170, 270 of the at least one retention feature 164, 264 to militate against movement in a first direction towards the discharge port 156 and/or the shoulder 199 may be configured to engage the second axial surface of the fluid separators 155, 255 to militate against movement in an opposite second direction away from the discharge port 156.

Figures 12A, 12B, 12C, 12D:
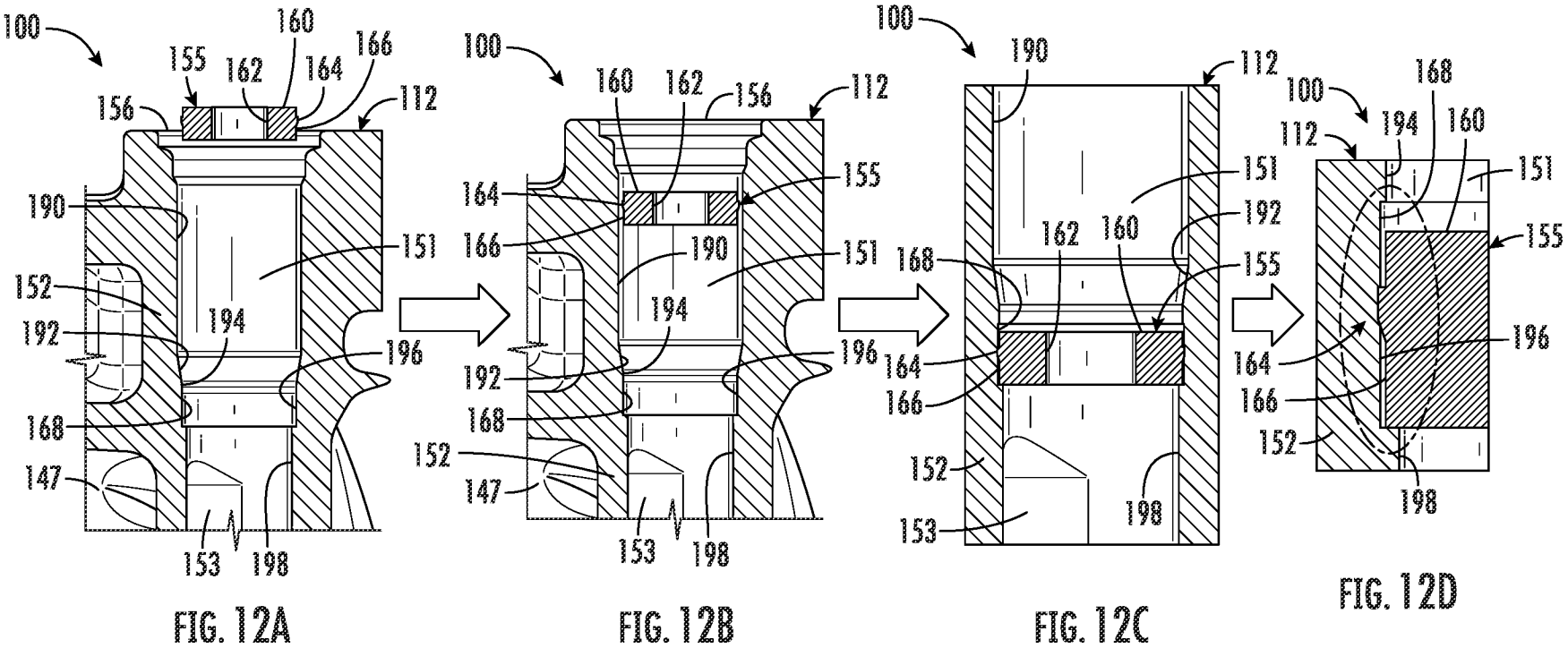
FIG. 12A is a fragmentary section view of a portion of a scroll compressor showing pre-insertion of the fluid separator of FIGS. 7 and 8 into a separation chamber.
FIG. 12B is a fragmentary section view of the portion of the scroll compressor of FIG. 12A showing mid-insertion of the fluid separator of FIGS. 7 and 8 into the separation chamber.
FIG. 12C is a fragmentary section view of a portion of a scroll compressor showing a final position of the fluid separator of FIGS. 7 and 8.
FIG. 12D is an enlarged fragmentary section view of a portion of a scroll compressor showing the final position of the fluid separator of FIGS. 7 and 8, wherein a retention feature is more clearly depicted within a dashed circle area.

FIGS. 12A-12D illustrate an exemplary installation of the fluid separator 155. To install the fluid separator 155 in the compressor 100, the fluid separator 155 may be first aligned with the fluid separation chamber 151 and the discharge port 156 as depicted in FIG. 12A. Then, as shown in 12B, the fluid separator 100 may be inserted through the discharge port 156 and into the separation chamber 151. The fluid separator 100 within the separation chamber 151 may then be urged past the cylindrical portion 190, through the frustoconical portion 192, and past the contraction portion 194 until the at least one retention feature 164 is received and seated within the channel portion 196.

In some embodiments, an inner diameter of each of the discharge port 156 and the cylindrical portion 190 may substantially equal to or slightly larger than an outer diameter of the at least one retention feature 164 to facilitate insertion of the fluid separator 155 into the separation chamber 151. The fluid separator 155 may be inserted manually, automatically or semi-automatically and by hand or with a tool. An inner diameter of the frustoconical portion 192 gradually decreases from the inner diameter of the cylindrical portion 190 to an inner diameter of the contraction portion 194, which has a slightly smaller inner diameter than the outer diameter of the at least one retention feature 164 of the fluid separator 155. An inner diameter of the channel portion 196 may be substantially equal to or slightly larger than the outer diameter of the at least one retention feature 164. An inner diameter of the remainder portion 198 of the separation chamber 151 adjacent the channel portion 196 may be substantially the same as or slightly larger than an outer diameter of the main body 160 of the fluid separator 155, but smaller than the inner diameter of the channel portion 196. Thus, based upon the differences in the inner diameters of the portions 194, 198 of the separation chamber 151 adjacent both sides of the channel portion 196, the at least one retention feature 164 is axially constrained by the shoulders 197, 199 formed on each side of the channel portion 196, thereby effectively locking the fluid separator 155 in place when fully installed. It should be noted that adjusting a location of the channel portion 196 axially one way or the other in the separation chamber 151 to adjust and provide a desired position of the fluid separator 155 relative to the discharge passage 153 and/or the discharge port 156 and/or the fluid passage 57.

An installation of the fluid separation 255 is similar to that described hereinabove for the fluid separator 155.

The compressors 100 having one of the fluid separators 155, 255 with a simplified structure is easy to manufacture, thereby reducing machining tolerances and minimizing production costs. Press fitting, staking, clipping, screwing, and other methods used during assembly and installation in the prior art are not required, reducing part count and overall assembly complexity. The novel fluid separators 155, 255 of the instant patent application can be used in multiple compressors, thereby eliminating the need for a special design for each compressor, thereby further minimizing overall part cost. The retention features 164, 264 of the respective fluid separators 155, 255 in the compressor 100 also provide sealing and prevent bypass of the second fluid within the first fluid to ensure that a sufficient amount of second fluid is supplied from the fluid separation chamber 151 to the various other moving components of the compressor 100, thereby improving a durability of the compressor 100.

From the foregoing description, one ordinarily skilled in the art can easily ascertain the essential characteristics of this present disclosure and, without departing from the spirit and scope thereof, can make various changes and modifications to the present disclosure to adapt it to various usages and conditions.

What is claimed is:

1. A fluid separator for a compressor, comprising:

a main body including at least one retention feature formed to extend radially outwardly from an outer surface thereof and configured to permit the fluid separator to be fixedly positioned in the compressor at a desired location, wherein a fluid separation chamber of the compressor includes a receiving feature configured to receive the at least one retention feature so that movement of the fluid separator is prevented as the fluid separator is axially constrained by shoulders of the compressor formed on each side of the receiving feature, wherein the at least one retention feature contacts an inner surface of the fluid separation chamber and spaces a remainder of the outer surface of the main body from the inner surface of the fluid separation chamber on both axial sides of the at least one retention feature.

2. The fluid separator of claim 1, wherein the main body further includes at least one aperture formed therein.

3. The fluid separator of claim 1, wherein the at least one retention feature is configured to cooperate with a surface of the compressor to form a substantially fluid-tight seal therebetween.

4. The fluid separator of claim 1, wherein the at least one retention feature is at least one radially outwardly extending protuberance.

5. The fluid separator of claim 1, wherein the at least one retention feature is at least one radially outwardly extending surface element.

6. The fluid separator of claim 1, wherein the at least one retention feature is an annular array of spaced apart surface elements.

7. The fluid separator of claim 1, wherein the at least one retention feature is formed continuously around the outer surface of the main body.

8. The fluid separator of claim 1, wherein the at least one retention feature includes a sloped portion to facilitate installation of the fluid separator in the compressor.

9. The fluid separator of claim 1, wherein the receiving feature is a radially extending channel portion formed in the fluid separation chamber.

10. The fluid separator of claim 1, wherein the fluid separator further includes a tube portion extending outwardly from the main body.

11. A compressor, comprising:

a housing including a discharge chamber and a fluid separation chamber, wherein the fluid separation chamber is in communication with the discharge chamber to receive a first fluid having a second fluid suspended therein; and a fluid separator disposed in the fluid separation chamber, wherein the fluid separator includes:

a main body including at least one retention feature formed to extend radially outwardly from an outer surface thereof and configured to permit the fluid separator to be fixedly positioned at a desired location within the fluid separation chamber, wherein the fluid separation chamber of the compressor includes a receiving feature configured to receive the at least one retention feature so that movement of the fluid separator is prevented as the fluid separator is axially constrained by shoulders of the compressor formed on each side of the receiving feature, wherein the at least one retention feature contacts an inner surface of the fluid separation chamber and spaces a remainder of the outer surface of the main body from the inner surface of the fluid separation chamber on both axial sides of the at least one retention feature.

12. The compressor of claim 11, wherein the at least one retention feature is configured to cooperate with a surface of the fluid separation chamber to form a substantially fluid-tight seal therebetween.

13. The compressor of claim 11, wherein the at least one retention feature is at least one radially outwardly extending protuberance.

14. The compressor of claim 11, wherein the at least one retention feature is an annular array of spaced apart surface elements.

15. The compressor of claim 11, wherein the at least one retention feature is formed continuously around the outer surface of the main body.

16. The compressor of claim 11, wherein the at least one retention feature includes a sloped portion to facilitate installation of the fluid separator in the compressor.

17. The compressor of claim 11, wherein the receiving feature is a radially extending channel portion formed in the fluid separation chamber.

18. The compressor of claim 11, wherein the fluid separator further includes a tube portion extending outwardly from the main body.

19. The compressor of claim 11, wherein the fluid separation chamber includes a cylindrical portion, a frustoconical portion, and a channel portion.

20. A compressor, comprising:

a housing including a discharge chamber and a fluid separation chamber, wherein the fluid separation chamber is in communication with the discharge chamber to receive a first fluid having a second fluid suspended therein, and wherein the fluid separation chamber includes a channel portion; and a fluid separator disposed in the fluid separation chamber and configured to separate the second fluid from the first fluid, wherein the fluid separator includes at least one retention feature formed to extend radially outwardly from an outer surface thereof and is configured to be received in the channel portion of the fluid separation chamber, and wherein movement of the fluid separator is prevented as the at least one retention feature is axially constrained by shoulders formed on opposite sides of the channel portion, wherein the at least one retention feature contacts an inner surface of the fluid separation chamber and spaces a remainder of the outer surface of the fluid separator from the inner surface of the fluid separation chamber on both axial sides of the at least one retention feature.

* * * * *